US005586667A

United States Patent [19]

Landry

[11] Patent Number: 5,586,667

[45] Date of Patent: Dec. 24, 1996

[54] MOBILE CRANE WITH MAIN AND AUXILIARY COUNTERWEIGHT ASSEMBLIES

[76] Inventor: Camile J. Landry, 12636 Bristol Ave., Baton Rouge, La. 70815

[21] Appl. No.: 572,086

[22] Filed: Dec. 14, 1995

[51] Int. Cl.[6] ..... B66C 23/76

[52] U.S. Cl. ..... 212/196; 212/195; 212/298

[58] Field of Search ..... 212/195, 196, 212/197, 178, 279, 298

[56] References Cited

U.S. PATENT DOCUMENTS

| | | | |
|---|---|---|---|
| 3,842,984 | 10/1974 | Brown et al. . | |
| 4,166,542 | 9/1979 | Bryan, Jr. . | |
| 4,258,852 | 3/1981 | Juergens . | |
| 4,492,312 | 1/1985 | Poock . | |
| 4,540,097 | 9/1985 | Wadsworth et al. . | |
| 5,005,714 | 4/1991 | Kröll et al. . | |
| 5,035,337 | 7/1991 | Juergens . | |
| 5,222,613 | 6/1993 | McGhie | 212/195 |

FOREIGN PATENT DOCUMENTS

| | | | |
|---|---|---|---|
| 1463705 | 3/1989 | U.S.S.R. | 212/196 |

OTHER PUBLICATIONS

Grove Manufacturing Company, "Grove RT630 Hydraulic Cranes" Form No. SBRT630–15M pp. 1–14.

*Primary Examiner*—Thomas J. Brahan

*Attorney, Agent, or Firm*—Nilles & Nilles, S.C.

[57] ABSTRACT

A mobile crane has main and auxiliary counterweight assemblies and is arranged such that the spar or mast on which the auxiliary counterweight assembly is mounted is of a two-piece construction such that, upon the imposition of a load on the main boom of the crane which is sufficient to deflect the boom, the outer end or tip of the spar pivots to lift the auxiliary counterweight assembly from the ground, thereby opposing the bending forces imposed on the boom and allowing the platform to rotate about a vertical slewing axis without obstruction from the auxiliary counterweight assembly. The spar and thus the entire crane is compact, lightweight, easy to assemble and disassemble, and can operate in a relatively restricted space without interference from obstacles around its rear. In the case of a crane having a telescoping boom, parts of the load line can be used to create a pendant effect which takes some of the bending forces out of the boom in addition to lifting the auxiliary counterweight assembly, thereby obviating the need for external pendant pay-out systems required on most telescoping cranes.

21 Claims, 6 Drawing Sheets

MOBILE CRANE WITH MAIN AND AUXILIARY COUNTERWEIGHT ASSEMBLIES

BACKGROUND OF THE INVENTION

1. Field of the Invention

The invention relates to mobile cranes, and more particularly, to mobile cranes having main and auxiliary counterweight assemblies.

2. Discussion of the Related Art

Mobile cranes are well known for lifting heavy loads ranging from a few tons to hundreds of tons. Such cranes typically include a counterweight assembly which prevents or at least inhibits excessive boom deflection which could otherwise occur when the crane lifts heavy loads. Cranes of this general type are disclosed, for example, in U.S. Pat. Nos. 3,842,984 to Brown; 4,258,852 to Juergens; 4,540,097 to Wadsworth; and 5,035,337 to Juergens.

Cranes of the above-mentioned type typically include 1) an earthborne base, usually mounted on wheels or crawler treads, and 2) a platform mounted on the base for rotation about a vertical slewing axis. A boom is pivotally connected to the platform for swinging substantially in a vertical plane that contains the slewing axis. The boom is inclined with respect to the slewing axis such that it extends upwardly and forwardly from the base. A load line passes over the upper end of the boom and has one end which depends from the boom to be connectable with the load and an opposite end connected to a winch on the platform. The platform typically has a tail-like rearwardly-projecting portion to which is attached a main counterweight assembly that offsets the forward tilting forces exerted by the boom and by any light to moderately heavy load hoisted by the crane.

Cranes of the type described above may be provided with an auxiliary counterweight assembly to offset tilting effects imposed by extremely heaving loads. For instance, the above-mentioned Juergens '337 patent discloses a crane having 1) a conventional boom, 2) a conventional tail-like projection and the associated main counterweight assembly, and 3) a mast pivotally connected to the platform at a location behind the boom connection so as to allow the mast to swing relative to the platform in substantially the same plane that contains the swinging of the boom and the slewing axis. A tension line is connected between the upper ends of the boom and the mast so as to cause the boom and the mast to swing in unison and to normally cause the mast to project upwardly from the platform at a rearward inclination to the vertical slewing axis. An auxiliary counterweight assembly is attached to the top of the mast and is normally ground-supported. When a heavy load is being hoisted, the boom tends to swing forwardly and downwardly in reaction to the lifting forces exerted by the load, causing the entire mast to swing correspondingly forwardly and upwardly. Mast swinging lifts the auxiliary counterweight assembly off the ground so that the full weight of the auxiliary counterweight assembly, in addition to the weight of the main counterweight assembly mounted on the tail-like projection of the platform, is operable to offset the tilting forces exerted upon the boom by the load. In addition, a gantry structure, fixed on the rear part of the platform, is provided and has a lost motion connection with the mast that defines the forward limit of swinging motion of the boom relative to the platform.

Cranes of the type described above, though satisfactory, exhibit several drawbacks and disadvantages.

For instance, for transport from one job site to another, the crane must be partially disassembled into units that comply with size and weight limitations prescribed for highway vehicles. This requires that mobile cranes be as compact, light, and easy to assemble and disassemble as is consistent with its hoisting capacity. A crane of this type should also have the smallest possible tail swing, that is, the upper structure, including counterweight assemblies, should project the least possible distance behind the vertical slewing axis so that it can operate in a relatively restricted space without interference from obstacles around its rear. All of these goals are hindered by providing a relatively long spar or tail mast of the type employed by most cranes. Some, but not all of these problems are addressed and at least partially solved in the Juergens '337 patent.

Moreover, even in systems such as that disclosed in the Juergens '337 patent having an auxiliary counterweight assembly, the entire spar or mast pivots about the platform upon main boom deflection. As a result, the main and auxiliary counterweight assemblies come into play simultaneously such that substantially all boom deflection occurs against the total reactive forces of the main and auxiliary counterweight assemblies and against the weight of the entire spar in all instances. Therefore, the number of auxiliary counterweights need to be precisely determined and controlled so as to provide the required reaction forces. The total weight of the spar and the auxiliary counterweight assembly also must travel forward in a dynamic, uncontrolled manner because the spar travels upward, pivoting at the base of the platform. Consequently, the center of gravity moves forward along with the load of the boom, thereby actually accelerating boom swinging—a result which is exactly opposite that sought through the use of the auxiliary counterweight assembly.

Some of the above discussed problems are exasperated in the case of multi-section, pendant-supported, telescopic booms of the type having a pendant pay-out system for preventing the boom from bending downwardly while lifting heavy loads. The conventional system disclosed, for example, in U.S. Pat. No. 4,492,312 to Poock, employs an external pendant pay-out system to straighten the boom and to add additional counterweights to compensate for heavy loads. Such external pendant pay-out systems are used in addition to the spar or mast supported auxiliary counterweight assemblies of the type described above, thereby complicating the system.

OBJECTS AND SUMMARY OF THE INVENTION

It is therefore an object of the invention to provide a mobile crane with main and auxiliary counterweight assemblies which provide for smooth lifting of the auxiliary counterweight assembly off the ground without requiring pivoting of the entire mast or spar on which the auxiliary counterweight assembly is mounted, thereby negating the need for the total weight of the spar and auxiliary counterweight assembly to travel forward in a dynamic, uncontrolled manner.

Another object of the invention is to provide an improved mobile crane of the type described above which has an upper structure which, as compared to heretofore conventional upper structures of such cranes, is lighter, more compact, less expensive, provides a shorter tail swing, and is more easily assembled and disassembled for converting the crane between its transport and its operating conditions.

In accordance with a first aspect of the invention, these objects are achieved by providing a crane comprising a ground-supported base, a platform supported on the base, an elongated boom, and an elongated spar. The boom has a lower end pivotally mourned on the platform and is confined to swing relative to the platform substantially in a vertical plane. The spar, which is substantially shorter than the boom, includes a spar body and a spar tip. The spar body has (1) a lower, from end which is mounted on the platform and which is spaced rearwardly from the lower end of the boom, and (2) an upper, rear end. The spar tip has a lower end connected to the upper end of the spar body by (1) a pivot pin and (2) a lost motion connection so as to be capable of limited pivotal motion with respect to the spar body through a range having upper and lower limits. A main counterweight assembly is suspended from the spar body. An auxiliary counterweight assembly is connected to the spar tip so as to be supported on the ground when the spar tip is in its lower limit of pivotal motion but otherwise to be suspended from the spar tip. A boom suspension assembly connects the spar tip to the upper end of the boom.

Optionally (and preferably in the case of a non-telescoping boom), the lost motion connection comprises a hydraulic cylinder having a first end pivotally connected to the spar body and a second end pivotally connected to the spar tip, the cylinder being extendible upon demand to rotate the spar tip into a position permitting connection of the auxiliary counterweight assembly to the spar tip. A mechanical stop, which cooperates with one of the cylinders and the spar tip, may be provided to determine the upper limit of spar tip motion, thereby eliminating the need for a gantry structure.

Also in the case of a non-telescoping or conventional boom, the boom suspension assembly preferably comprises a winch mourned on the spar, fleeting sheaves mounted on the spar, a spar tip bail mounted on the spar tip, an outer bail located between the spar tip and the boom tip, reeving running back and forth over the winch, the sheaves, the spar tip bail, and the outer bail a plurality of times, and pendants running from the outer bail to the boom tip. The boom suspension assembly maintains a designated constant distance between the upper end of the boom and the upper end of the spar tip, the designated distance being variable by operation of the winch.

Yet another object of the invention is to provide a telescoping crane having one or more of the characteristics described above and which provides an improved method of compensating for boom deflection while simultaneously adding additional counterbalance without the use of an external pendant pay-out system or the like.

In this case, the boom suspension assembly preferably comprises a boom tip bail mounted on the upper end of the boom, a spar tip bail mounted on the upper end of the spar tip, a load winch mounted on the spar, and a load line which extends from the load winch to the boom tip bail and which is wound back and forth a plurality of times from the boom tip bail to the spar tip bail, thereby to (1) create a lifting force on the spar tip bail and the auxiliary counterweight assembly and (2) create an upward force on the boom tip and overcome boom deflection. Moreover, the lost motion connection preferably comprises a compression link having a first end pivotally connected to the spar body and a second end pivotally connected to the spar tip.

Still another object of the invention is to provide an improved method of lifting a load.

In accordance with another aspect of the invention, this object is achieved by first providing a crane including (1) a ground-supported base, (2) a platform supported on the base, (3) an elongated boom having a lower end pivotally mounted on the platform and having an upper end, the boom being confined to swing relative to the platform substantially in a vertical plane, (4) an elongated spar, and (5) a main counterweight assembly suspended from the spar body. The spar, which is substantially shorter than the boom, includes (1) a spar body having a lower, front end which is mounted on the platform and which is spaced rearwardly from the lower end of the boom, and (2) an upper spar tip, the spar tip having an upper end and having a lower end connected to the spar body by a pivot pin and by a lost motion connection. Subsequent steps include attaching an auxiliary counterweight assembly to the spar tip so that the auxiliary counterweight assembly is supported on the ground, imposing a load on the boom which causes the second end of the boom to deflect downwardly and forwardly, and pivoting the spar tip about the spar body, without pivoting the spar body, upon the downward and forward movement of the boom, thereby to lift the auxiliary counterweight assembly off the ground so that the auxiliary counterweight assembly resists further movement of the boom.

The attaching step preferably includes pivoting the spar tip from a first position in which it is inaccessible by the auxiliary counterweight assembly to a second position in which it is accessible by the auxiliary counterweight assembly, then attaching the auxiliary counterweight assembly to the spar tip; and then pivoting the spar tip back into the first position.

In the case of a conventional or non-telescoping boom, the step of pivoting the spar tip from the first position to the second position preferably comprises actuating a hydraulic cylinder which has a first end pivotally connected to the spar body and a second end connected to the spar tip.

In the case of a telescoping boom, the step of providing a lost motion connection preferably comprises providing a telescoping compression link pivotally connected to the spar tip and to the spar body, and the step of pivoting the spar tip upon the imposition of the load on the boom comprises pivoting the spar tip about the pivot pin while the telescoping compression link telescopes.

These and other objects, features, and advantageous of the invention will become more readily apparent to those skilled in the art from the detailed description and the accompanying drawings. It should be understood, however, that the detailed description and the specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DESCRIPTION OF THE PREFERRED EMBODIMENTS

1. Resume

Pursuant to the invention, a mobile crane is provided which has main and auxiliary counterweight assemblies and which is arranged such that the spar or mast on which the auxiliary counterweight assembly is mounted is of a two-piece construction such that, upon the imposition of a load on the main boom of the crane which is sufficient to deflect the boom, the outer end or tip of the spar pivots to lift the auxiliary counterweight assembly from the ground, thereby opposing the bending forces imposed on the boom and allowing the platform to rotate about a vertical slewing axis without obstruction from the auxiliary counterweight assembly. Due to its two-piece construction, the manner in which it is mounted on the platform of the crane, and the fact that it is substantially shorter than the boom, the spar and thus the entire crane is compact, lightweight, easy to assemble and disassemble, and can operate in a relatively restricted space without interference from obstacles around its rear. A lost motion connection is provided between the spar tip and the spar body. The lost motion connection could comprise e.g., a compression link or hydraulic cylinder, the latter being operable to permit the spar tip to be pivoted from a position in which it would otherwise be inaccessible by the auxiliary counterweight assembly to a position permitting attachment of the auxiliary counterweight assembly to the spar. In the case of a crane having a telescoping boom, parts of the load line can be used to create a pendant effect which takes some of the bending forces out of the boom in addition to lifting the auxiliary counterweight assembly, thereby obviating the need for external pendant pay-out systems required on most telescoping cranes.

2. Construction of First Embodiment

Figure 1:
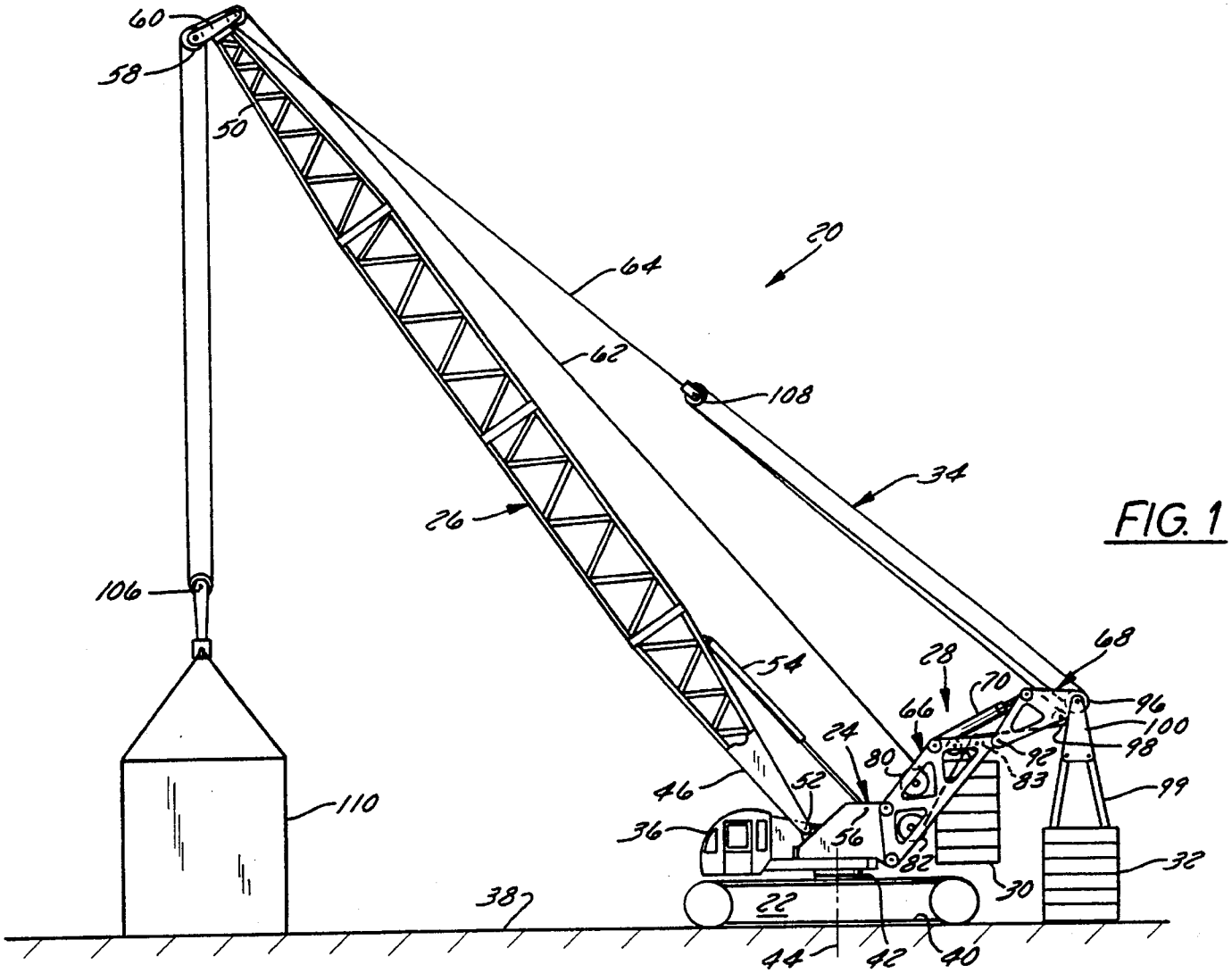
FIG. 1 is a side elevation view of a mobile crane constructed in accordance with a first embodiment of the invention and illustrated an auxiliary counterweight assembly thereof in a lowered or inactive position.
Figure 2:
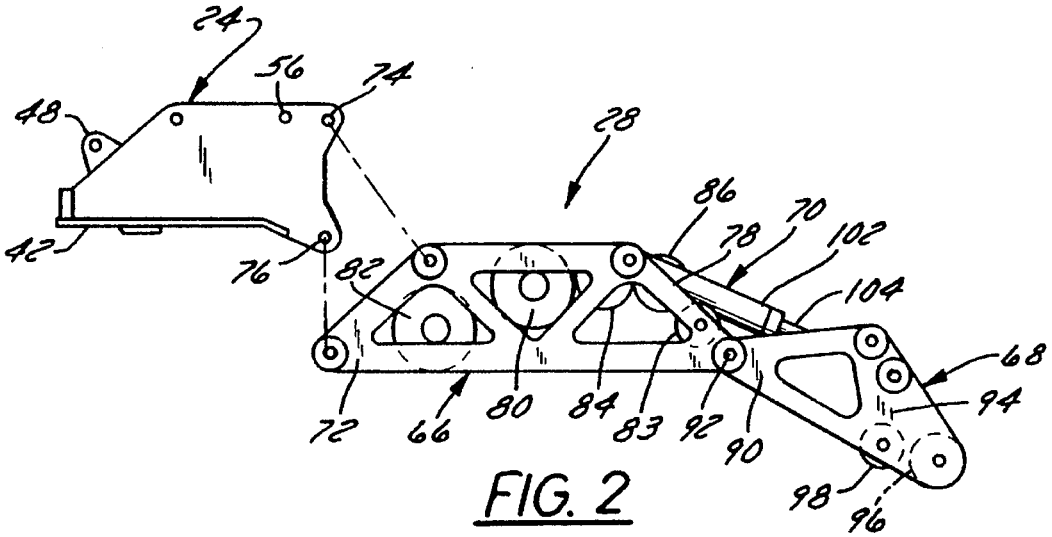
FIG. 2 is a partially exploded side elevation view of the platform and spar of the crane illustrated in FIG. 1, illustrating a hydraulic cylinder of the spar in an extended position.
Figure 3:
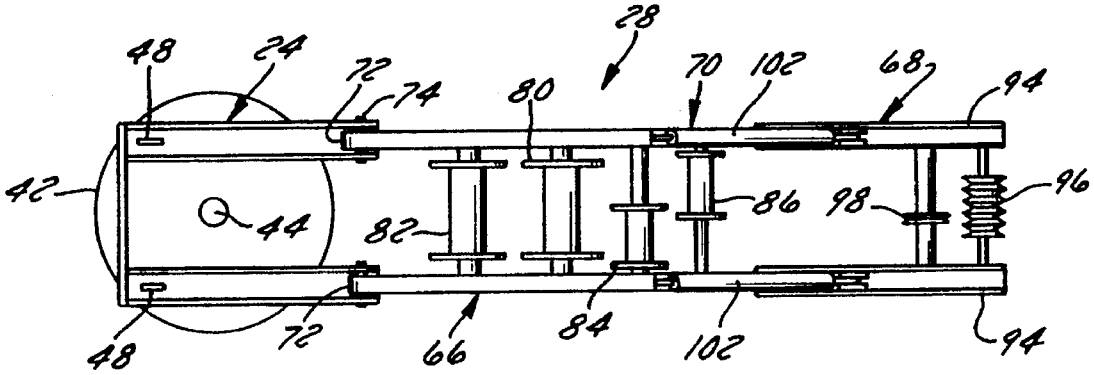
FIG. 3 is a top plan view of the spar and platform of the crane illustrated in FIG. 1.
Figure 4:
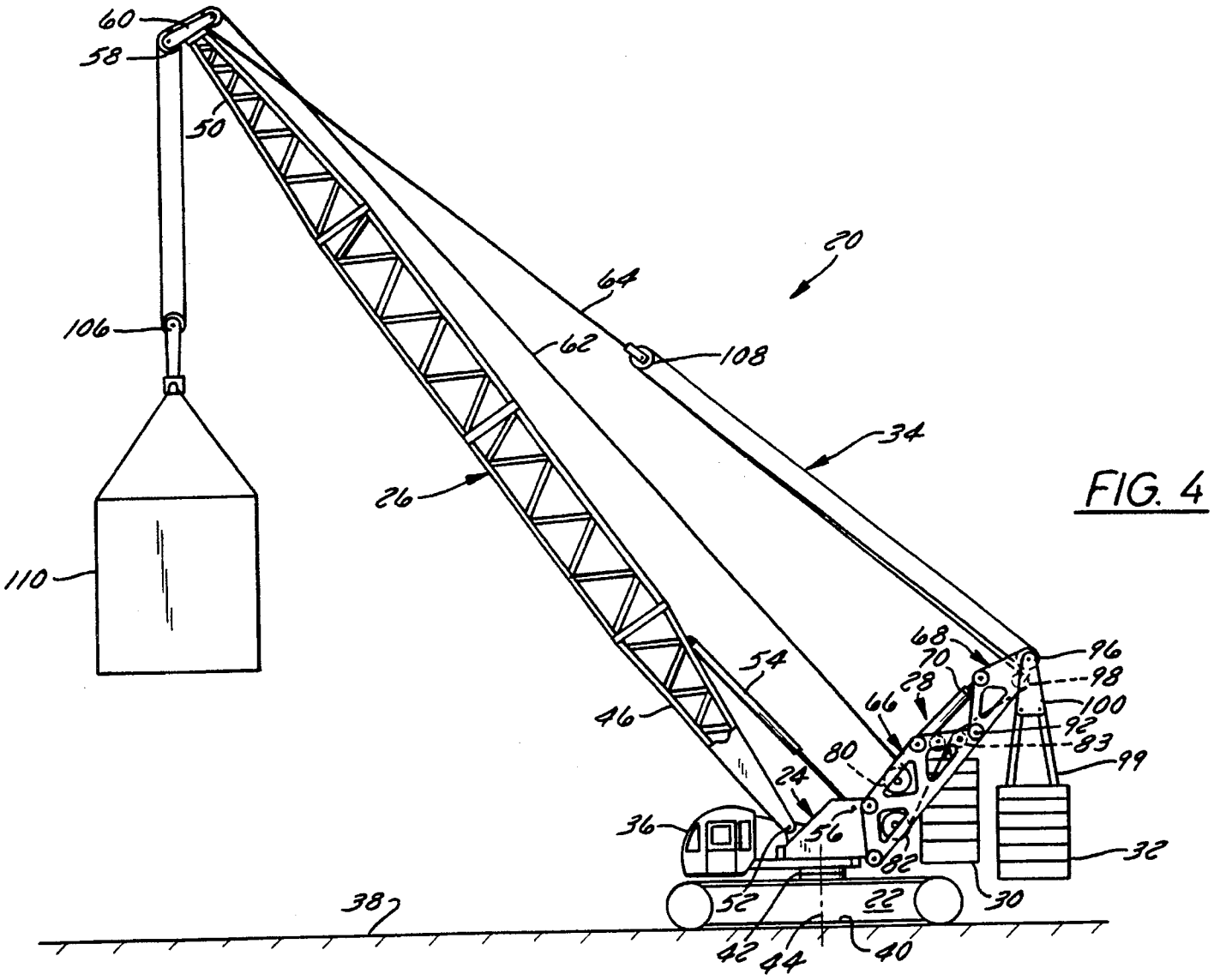
FIG. 4 is a side elevation view of the crane illustrated in FIG. 1, illustrating the spar in a position in which the auxiliary counterweight assembly is lifted from the ground in reaction to the imposition of a load on the crane.
Figure 10:
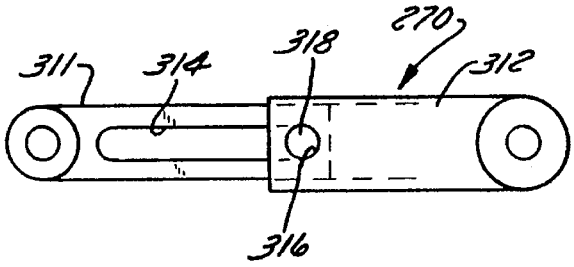
FIG. 10 is a side elevation view of a compression link mechanism of the spar illustrated in FIGS. 7–9.

Referring now to the drawings and to FIGS. 1–5 in particular, a mobile crane 20 constructed in accordance with a first preferred embodiment of the invention includes a ground-supported base 22 and a platform 24 supported on the base. Mounted on the platform 24 are an elongated boom 26, a spar 28, main and auxiliary counterweight assemblies 30 and 32, respectively, a boom suspension assembly 34, and an operator's cab 36. The base 22 is supported on the ground 38, by crawler treads 40, but could just as well be supported by outriggers or wheels. The platform 24 and operator's cab 36 could be fixed to the base 22 but are preferably mounted on the base by a turret 42 permitting rotation of the platform and cab about a vertical slewing axis 44 (FIGS. 1, 3 and 4).

Figure 5:
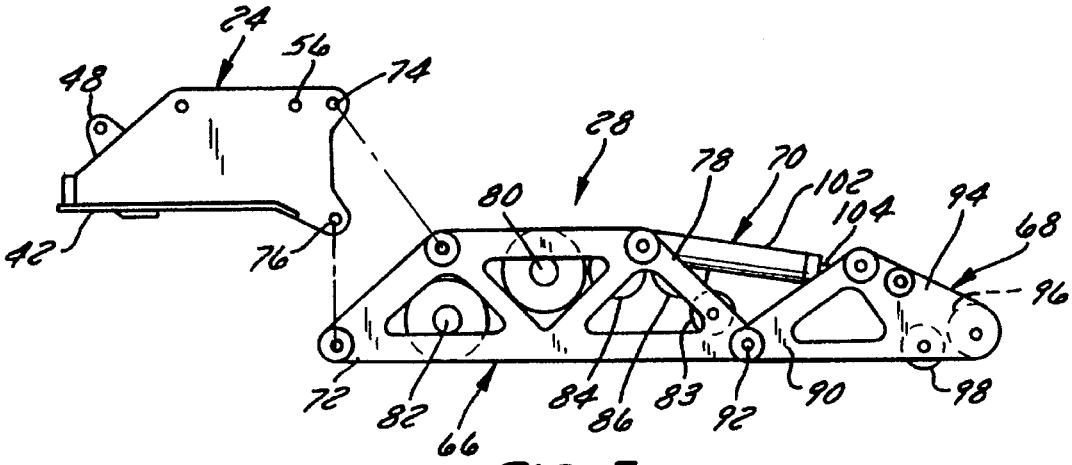
FIG. 5 is a partially-exploded side elevation view corresponding to FIG. 4 and illustrating the cylinder in a retracted position.

The boom 26 has a lower end 46 and an upper end 50 extending upwardly and forwardly from its lower end 46 and terminating in a boom tip 60. The lower end 46 pivots about a pivot point 52 (FIGS. 1 and 4) formed by ear mounts 48 on the platform 24 (FIGS. 2 and 5). The ear mounts 48 and pivot point 52 are located in front of the vertical slewing axis 44 about which the platform 24 rotates so that the boom 26 is confined to swing in a vertical plane that contains or is adjacent to the vertical slewing axis 44. A conventional boom backstop 54 extends from the boom to a pivot mount 56 on the platform 24. A sheave assembly 58 is mounted on a tip 60 (FIGS. 1 and 4) of the boom 26 and receives load lines 62. The tip 60 of the boom also receives pendants 64 of the boom suspension assembly 34 as detailed below.

The spar 28 has several features of note. First, it is substantially shorter than the boom 26 so as to facilitate crane assembly, disassembly, and transport and so as to cause the crane 20 to have a relatively small tail swing, thereby permitting the crane 20 to be operated in a relatively restricted space without interference from obstacles around its rear. Second, as will be detailed further below, all of the hoisting and luffing winches of the crane 20 are mounted on the spar 28, thereby adding to the spar's weight and increasing its effectiveness as a counterweight device. Third, and perhaps most importantly, the spar 28 is of a two-piece construction so as to provide improved reaction to the imposition of loads on the crane 20.

Towards these ends, the spar 28 is affixed to the platform 24 at its lower end and extends upwardly and rearwardly from the platform 24 so as to be located substantially in the plane containing the boom 26 and the vertical slewing axis 44 at all times. The spar includes a lower spar body 66, an upper spar tip 68, and a lost motion connection 70 connecting the spar tip 68 to the spar body 66 and permitting limited swinging movement of the spar tip 68 in a plane containing the spar 28, the boom 26 and the slewing axis 44. Each of these structures will now be defined in further detail.

The spar body 66 has a lower end 72 mounted on ear mounts 74, 76 of platform 24 and has an upper end 78 positioned above and behind the lower end 72. Mounted on the spar body 66 between its lower and upper ends 72 and 78 are a load winch 80, a boom hoist winch 82, and a fleeting sheave 83. A pair of auxiliary winches 84, 86 are also mounted on the spar body 66 and, apart from being mounted on the spar body 66 for added counterweight, form no part of the present invention. The main counterweight assembly 30 is suspended from the spar body 66 near the upper end 78 thereof.

The rigid spar tip 68, which, as clearly illustrated in the drawings, is formed from a plurality of members immovably attached to one another, has a lower end 90 pivotally mounted directly on the spar body 66 by pivot pins 92 and has an upper end 94 located above and to the rear of the lower end 90. The spar tip 68 also supports an upper spar tip bail 96 and an intermediate sheave assembly 98. A pendant 100 depends from the upper end 94 of the spar tip 68 for receiving a hoist link 99 for the auxiliary counterweight assembly 32.

The lost motion connection 70 may comprise any structure interconnecting the spar body 66 and the spar tip 68 so as to permit limited pivotal or swinging motion of the spar tip 68 about the pivot pins 92. In the illustrated and preferred embodiment, the lost motion connection 70 includes a pair of hydraulic cylinders each of which has a cylinder end 102 connected to the upper end 78 of the spar body 66 by a first pivot pin and a rod end 104 connected to the spar tip 68 by a second pivot pin. Hydraulic cylinders are preferred because 1) they can be selectively pressurized to rotate the spar tip 68, about its pivot pins 92, from the position illustrated in FIGS. 4 and 5 in which it is inaccessible by the auxiliary counterweight assembly 32 to the position illustrated in FIGS. 1–3 in which the auxiliary counterweight assembly 32 can be attached to the pendant 100, and 2) they can be neutralized hydraulically to float back to their retracted positions when a load is lifted. Hydraulic cylinders also eliminate the need for a gantry structure of the type employed in the Juergens '337 patent because, in their fully retracted or bottomed-out position, they provide a convenient mechanical stop for limiting upward or forward pivotal movement of the spar tip 68 thereby to limit boom deflection. Of course, other stops, located between the spar body 66 and the spar tip 68, would serve equally as well for this purpose.

A conventional load lifting assembly is also provided and includes the load winch 80, the sheave assembly 58 on the boom tip 60, a load block 106, and the load line 62. The load line 62 extends from the load winch 80, over the sheave assembly 58, to the load block 106, and back and forth as many times as needed depending upon load.

The boom suspension assembly 34 maintains a designated distance between the upper end 50 of the boom 26 and the upper end 94 of the spar tip 68. In the illustrated and preferred embodiment, the boom suspension assembly 34 includes the boom hoist winch 82, the fleeting sheave 83, a spar tip bail 96, a fleeting sheave 98 mounted on the spar tip 68, and an outer bail 108 located between the upper end 94 of the spar tip 68 and the boom tip 60. The boom hoist winch reeving runs from the boom hoist 82, over the fleeting sheave 83, to the fleeting sheave 98, to the spar tip bail 96, to the outer bail 108, and back to the spar tip 68 as many times as needed depending upon boom length. The boom suspension assembly 34 is completed by pendants extending from the outer bail 108 to the boom tip 60. The boom suspension assembly 34 maintains a designated distance between the upper end 50 of the boom 26 and the upper end 94 of the spar tip 68. The designated distance can be varied by operation of the boom hoist winch 82.

3. Operation of First Embodiment

In operation, after being transported to a work site from a remote location, the crane 20 is assembled in a manner which is well known to those skilled in the art or, in the case of the spar 28, is believed to be self evident from FIGS. 1–3 of the drawings and from Section 2 above. Next, the hydraulic cylinders 70 are extended to rotate the spar tip 68 from the position illustrated in FIGS. 4 and 5 in which the pendant 100 is inaccessible by the auxiliary counterweight assembly 32 to the position illustrated in FIGS. 1–3 in which the hoist link 99 for the auxiliary counterweight assembly 32 can be attached to the pendant 100 while still being supported on the ground 38. Then, a load 110 is attached to the load block 106 and is lifted by operation of the load winch 80. This operation imposes a load on the boom 26, causing it to deflect forwardly and downwardly as illustrated in the drawings. The boom 26 and spar tip 68 continue to pivot for a short time until further pivotal movement of the spar tip 68 relative to the spar body 66 is prevented by mechanical stops (if provided) or by bottoming out of the hydraulic cylinders 70. Further boom deflection is opposed not only by the auxiliary counterweight assembly 32, but also by the main counterweight assembly 30, the weight of the spar body 66, and weight of the winches 80, 82 and other devices mounted on the spar 28.

The reaction of the crane 20 to loads imposed on the boom 26 represents a marked advantage over prior art systems in which the entire spar pivoted. Because the auxiliary counterweight assembly 32 reacts first and lifts smoothly from the ground 38 via pivotal movement of the spar tip 68, one need not be very precise in the number of counterweights being employed. Moreover, because the total weight of the spar 28 and counterweight assemblies 30 and 32 do not travel forward in a dynamic, uncontrolled manner, and because the center of gravity of the spar 28 does not move forwardly, there is no acceleration of spar movement, resulting in a smoother reaction to boom pivoting.

4. Construction of Second Embodiment

Turning now to FIGS. 6–12, a crane 220 constructed in accordance with a second embodiment of the invention is illustrated which differs conceptually from the crane of the first embodiment primarily in that 1) a hydraulic telescoping boom 226 is provided and, 2) the lost motion connection 270 connecting the spar tip 268 to the spar body 266 takes the form of a compression link. In most other aspects, the crane 220 of the second embodiment is conceptually, if not structurally, identical to the crane 20 of the first embodiment. Elements of the second embodiment corresponding to those of the first embodiment are, accordingly, designated by the same reference numerals, incremented by 200.

Figure 6:
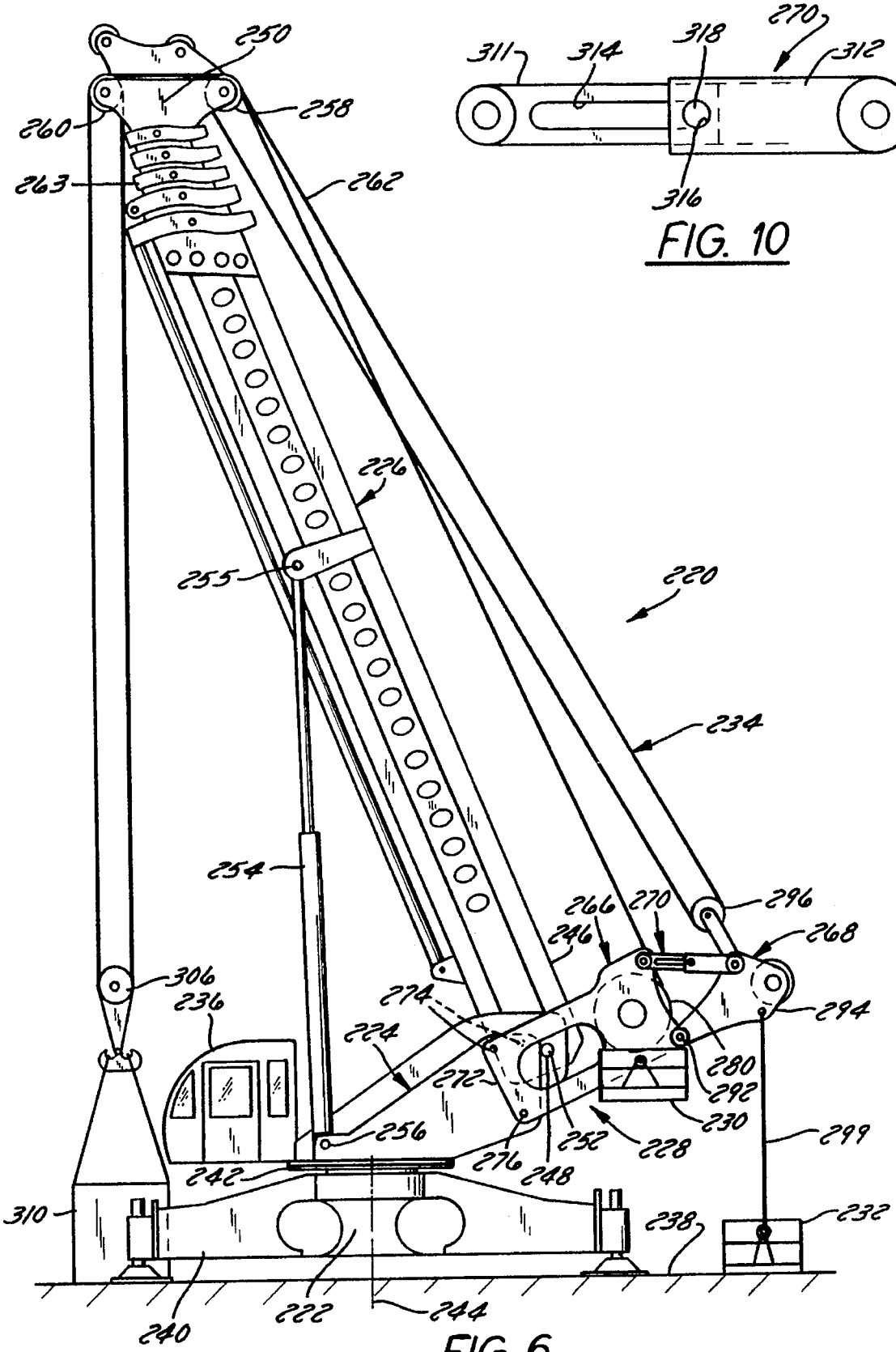
FIG. 6 is a side sectional elevation view of a crane constructed in accordance with a second preferred embodiment of the present invention and illustrating an auxiliary counterweight assembly thereof in a lowered or inactive position.
Figure 9:
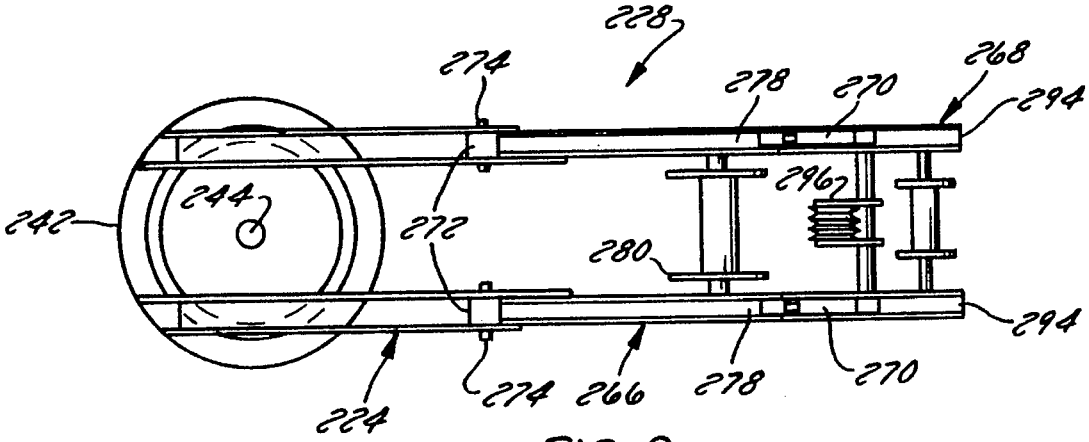
FIG. 9 is a top plan view of the spar and platform of the crane illustrated in FIG. 7.
Figures 11, 12:
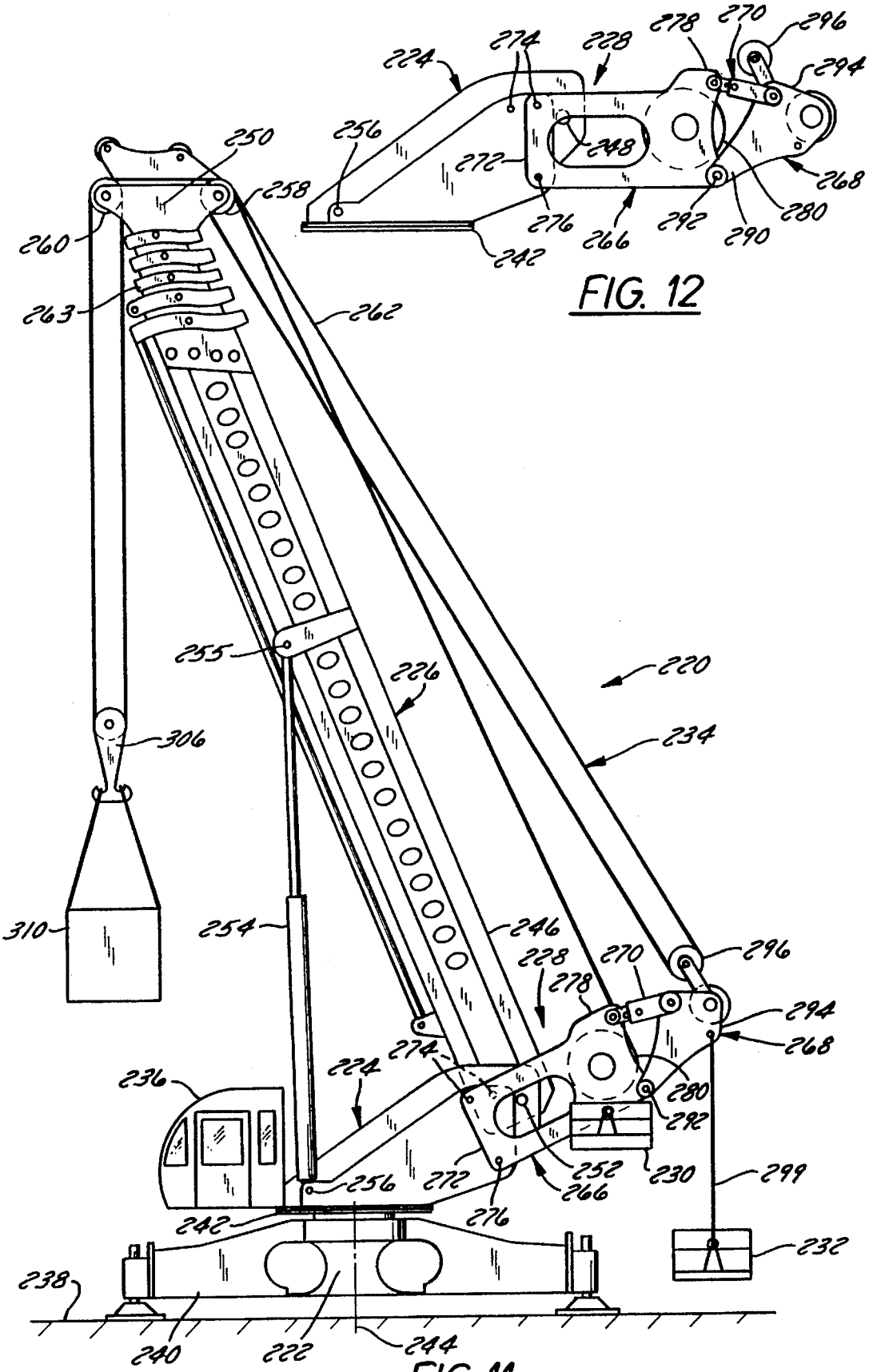
FIG. 11 is a side elevation view of the crane illustrated in FIG. 6, illustrating the spar in a position in which the auxiliary counterweight assembly is lifted from the ground in reaction to the imposition of a load on the crane.
FIG. 12 is a side elevation view of the spar and platform of the crane illustrated in FIGS. 6–11 and illustrating the spar in its load-bearing position.

Turning first to FIGS. 6 and 11, the crane 220 includes, like the crane 20 of the first embodiment, a ground supported base 222, a platform 224, an elongated boom 226, an elongated spar 228, main and auxiliary counterweight assemblies 230 and 232, a link 234, and an operator's cab 236. The base 222 is mounted on outriggers 240, it being understood that it also could be mounted on crawler treads or wheels. As in the first embodiment, the platform 224 and operator's cab 236 are mounted on the base 222 via a turret 242 so as to be rotatable about a vertical slewing axis 244 (FIG. 9).

Figure 7:
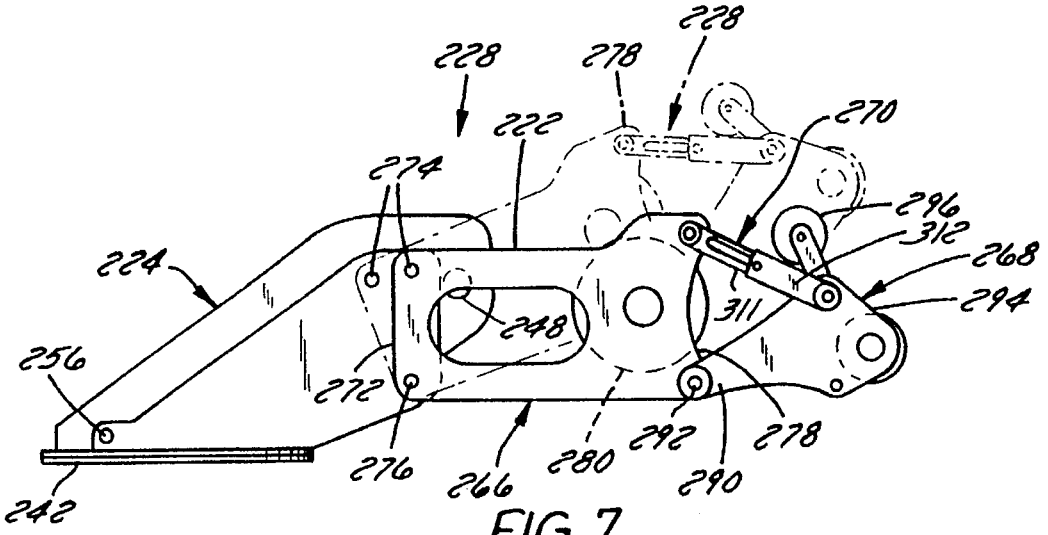
FIG. 7 is a side elevation view of the spar and platform of the crane illustrated in FIG. 6, illustrating the spar in an inactive or non-load bearing position.
Figure 8:
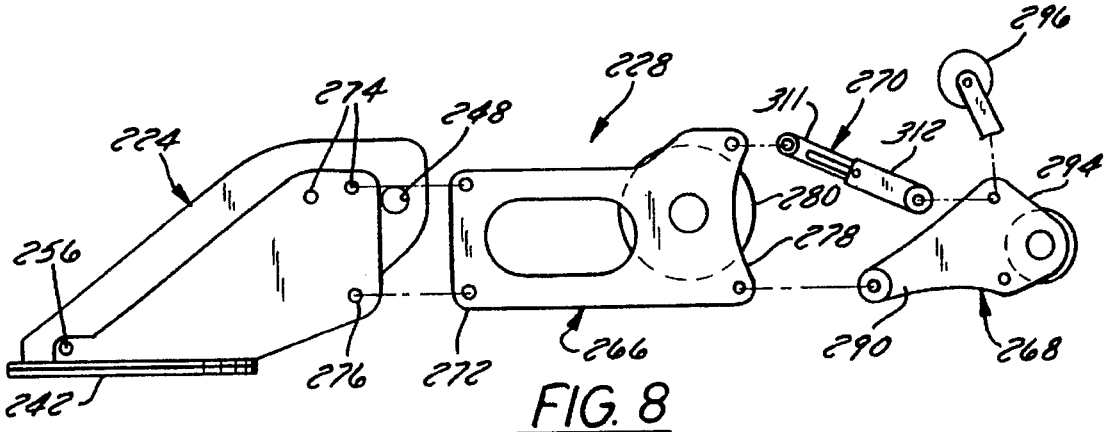
FIG. 8 is a partially-exploded side elevation view of the platform and spar illustrated in FIG. 7.

The boom 226 is a conventional telescoping boom having lower and upper ends 246 and 250, respectively. The lower end 246 pivots about a pivot point 252 (FIGS. 6 and 11) formed by apertures 248 in the platform 224 (FIGS. 7, 8, and 12). The apertures 248 and pivot point 252 are located in front of the vertical slewing axis 244 about which the platform 224 rotates so that the boom 226 is confined to swing in a vertical plane that contains or is adjacent to the vertical slewing axis 244. A conventional boom lift cylinder 254 extends from a pivot point 255 on a central portion of the boom 226 to a pivot mount 256 on the platform 224. Mounted on the upper end of the boom 226 are a boom tip bail 258 and a sheave assembly 260 for receiving a load line 262. The upper end 250 of the boom 226 is formed from a telescoping mechanism 263 which is, per se, well known and which therefore will not be detailed.

The spar 228, like the spar 28 of the first embodiment, is substantially shorter than the boom 226 and, because of its relatively short length, has all of the corresponding benefits of the spar of the first embodiment. The spar 228, like the spar 28 of the first embodiment, also is of a two-piece construction having a spar body 266 and a spar tip 268. The spar tip 268 is connected to the spar body 266 by pivot pins 292 and a lost motion connection 270.

The spar body 266 is located substantially in the same vertical plane as the boom 226 and the vertical slewing axis 244. Referring to FIGS. 7–9 and 12, the spar body 266 has a lower end 272 connected to the platform 224 by pins 274, 276 and an upper end 278 positioned above and behind the lower end 272. A load winch 280 is mounted on the spar body 266 near its upper end 278, and the main counterweight assembly 230 is suspended from the spar body 266 between the upper and lower ends thereof.

There are two sets of pins 274 on the platform 224, one located behind the other. This arrangement permits the orientation of the spar 228 relative to the platform 224 to be modified. That is, the spar 228 could be mounted on the front set of pins 274 to extend at a relatively steep incline as illustrated in FIGS. 6 and 11 and in solid lines in FIG. 7, or it could be mounted on the rear set of pins 274 to extend at a relatively shallow incline as illustrated in FIGS. 8, 9 and 12 and in phantom lines in FIG. 7. The orientation of the spar 28 of the first embodiment could be modified in the same manner.

The spar tip 268 is mounted on the spar body 266 so as to be confined to swing substantially in the vertical plane containing the boom 226, the spar body 266, and the vertical slewing axis 244. Referring to FIGS. 7–9 and 12, the spar tip 268 has a lower end 290 which is pivotally mounted to the upper end 278 of the spar body 266 by the pivot pins 292 and has an upper end 294 positioned above and behind the lower end 290. A spar tip bail 296 is mounted on the upper end 294 of the spar tip 268, and the auxiliary counterweight assembly 232 is attached to the spar tip 268 near the upper end thereof by a suitable line 299.

The link 234 between the upper end 250 of the boom 226 and the upper end 294 of the spar tip 268 is designed to eliminate external pendant pay-out systems associated with most telescoping booms while still permitting the auxiliary counterweight assembly 232 to react to the imposition of loads on the boom 226. To this end, the load line 262 extends 1) from the load winch 280, 2) to the boom tip bail 258, 3) back and forth from the boom tip bail 258 to the spar tip bail 296 a number of times as necessary to provide adequate strength for lifting the auxiliary counterweight assembly 232, and 4) to a load block 306.

The lost motion connection 270 could comprise cylinders as discussed above or virtually any other device defining upper and lower limits of travel of the spar tip 68. Referring to FIGS. 7–10 and 12, the illustrated lost motion connection 270 comprises a pair of telescoping compression links each of which includes a bar 311 and a hollow tube 312. The bar 311 of each compression link has a first end pivotally connected to the upper end 278 of the spar body 266 and a second end located between the first end thereof and the spar tip 268. An elongated slot 314 is formed in each bar 311 between the first and second ends thereof. The hollow tube 312 of each compression link slidably receives the associated bar 311 and has a first end pivotally connected to the spar tip 268 and a second end located between the first end thereof and the spar body 266. An aperture 316 is formed in each tube 312 between the first and second ends thereof and is aligned with the slot 314 in the associated bar 311. A pin 318 extends through the aperture 316 of each tube 312 and is slidably received in the slot 314 in the associated bar 311. Lower and upper limits of spar tip travel are determined by the length of the slots 314.

5. Operation of Second Embodiment

In use, the crane 220 is transported to the work site and then assembled. The load winch 280 is then actuated to pay out enough line to permit the spar tip 268 to pivot to the maximum extension of the compression links 270 thereby to facilitate access to the spar tip 268 by the hoist line 299 for the auxiliary counterweight assembly 232. The load block 306 is then attached to a load 310, and the load winch 280 is actuated to lift the load 310 from the position illustrated in FIG. 6 to the position illustrated in FIG. 11 in which the load 310 is lifted from the ground 238. Because the load line 262 doubles back and forth over the bails 258 and 296 several times before going to the block 306, the load line 262 creates a lifting force on the auxiliary counterweight assembly 232 during load lifting, thereby lifting the auxiliary counterweight assembly 232 from its ground supported position illustrated in FIG. 6 to its elevated position illustrated in FIG. 11 while simultaneously overcoming boom deflection. The maximum upward pivot of the spar 268 tip is determined by the length of the slot 314 in the compression link 270, with the lower or forward end of the slot 314 acting as a stop. Since the auxiliary counterweight assembly 232 is now lifted from the ground, the platform 224 is free to pivot about the vertical slewing axis 244 without obstruction from the auxiliary counterweight assembly 232. Once the spar tip 268 and compression links 270 assume this position further resistance to boom deflection is provided by the main counterweight assembly 230, the weight of the spar body 266, and the weight of the load winch 280 and other relatively heavy devices mounted on the spar 228.

It can thus be seen that the link 234 including the load line 262, boom tip bail 258, and spar tip bail 296 performs similarly to a conventional pendant pay-out system such as that disclosed in the Poock patent, while simultaneously adding counterbalance to the boom 226, without requiring the use of an external pay-out system. The resulting system is simpler, more compact, and easier to assemble and disassemble then that disclosed in the Poock patent. Moreover, unlike in the Poock patent, resistance to boom deflection is imposed progressively, first by the auxiliary counterweight assembly 232 and then by the main counterweight assembly 230 and spar body 266, rather than suddenly. It thus can be seen that, in this respect, the spar 228 and accompanying main and auxiliary counterweight assemblies 230, 232 function in much the same manner as the corresponding spar 28 and main and auxiliary counterweight assemblies 30, 32 of the first embodiment.

Boom telescoping has the same effect in this arrangement as it has on most conventional telescopic cranes in that, as the boom 226 telescopes out, the load block 306 travels vertically due to shortening of the load line 262 relative to the upper end 250 of the boom 226. If it is desired to hold the load 310 at a certain elevation while telescoping the boom 226, the load winch 280 must be actuated to pay out more of the line. Of course, the reverse occurs as the boom 226 telescopes in.

The primary difference between the first and second embodiments is that, with the telescoping boom 226 of the second embodiment, the back weaving of the load line 262 through the boom tip bail 258 and the spar tip bail 296 imposes an upward force on the boom upper end 250 that takes some of the downward deflection out of the telescoping boom 226 at the same time that additional ballast or counterweight is added to overcome boom deflection. With the conventional or non-telescoping boom 26 of the first embodiment, the spar tip 68 functions to add additional ballast only.

Many changes and modifications could be made to the present invention without departing from the spirit thereof. For instance, lost motion connections other than the illustrated cylinders or compression links could be employed. If a compression link or a similar device which cannot be forcefully pivoted is employed in the first embodiment in place of the cylinders, an auxiliary device could be used to raise the auxiliary counterweight assembly to a position suitable for connection to the spar tip, or the boom could be lowered to the ground to allow the spar tip to travel downward under its own weight. The scope of these and other changes will become apparent from the appended claims.

I claim:

1. A crane comprising:

(A) a ground-supported base;

(B) a platform supported on said base;

(C) an elongated boom having a lower end pivotally mounted on said platform and having an upper end, said boom being confined to swing relative to said platform substantially in a vertical plane; and (D) an elongated spar which is substantially shorter than said boom, said spar including (1) a lower spar body having i) a lower, from end which is mounted on said platform and which is spaced rearwardly from said lower end of said boom, and ii) an upper, rear end and (2) an upper rigid spar tip formed from a plurality of members immovably attached to one another, said spar tip having a lower end connected to said upper end of said spar body by a) a pivot pin pivotably coupling said spar tip directly to said spar body and b) a lost motion connection, said lost motion connection being pivotably coupled to said spar body and also being pivotably coupled to said spar tip at a location above and behind said pivot pin, said lost motion connection being axially compressible, said pivot pin and said lost motion connection operating to render said spar tip capable of limited pivotal motion with respect to said spar body through a range having upper and lower limits;

(E) a main counterweight assembly suspended from said spar body;

(F) an auxiliary counterweight assembly connected to said spar tip so as to be supported on the ground when said spar tip is in its lower limit of pivotal motion but otherwise to be suspended from said spar tip; and (G) a link connecting said spar tip to said upper end of said boom, wherein said spar tip, said lost motion connection, said pivot pin, said link, and said boom interact with one another such that, when said boom deflects forwardly and downwardly upon imposition of a load thereon, said boom deflection is resisted by said auxiliary counterweight assembly but not by said main conterweight assembly until said spar tip reaches an upper limit of pivotal motion, after which further boom deflection is resisted by both said auxiliary counterweight assembly and said main counterweight assembly.

2. A crane as defined in claim 1, wherein said lost motion connection comprises a hydraulic cylinder, said cylinder being 1) extendible upon demand to rotate said spar tip downwardly and rearwardly into a position permitting connection of said auxiliary counterweight assembly to said spar tip and 2) retractable upon boom deflection and consequent upward pivotal motion of said spar tip.

3. A crane as defined in claim 2, further comprising a mechanical stop which cooperates with one of said cylinder and said spar tip and which determines the upper limit of spar tip motion.

4. A crane as defined in claim 2, wherein said boom is a non-telescoping boom.

5. A crane as defined in claim 4, wherein said link comprises a boom suspension assembly which includes a boom hoist winch mounted on said spar body;

a first fleeting sheave mounted on said spar body;

a second fleeting sheave mounted on said spar tip;

a spar tip bail mounted on said spar tip;

an outer bail located between said upper end of said spar tip and said upper end of said boom;

a boom hoist winch reeving which runs from said boom hoist winch, to said first fleeting sheave, to said second fleeting sheave, to said spar tip bail, to said outer bail, and back to said spar tip a plurality of times;

pendants extending from said outer bail to said upper end of said boom, said boom suspension assembly maintaining a designated distance between said upper end of said boom and said upper end of said spar tip, said designated distance being variable by operation of said boom hoist winch.

6. A crane as defined in claim 1, wherein said lost motion connection comprises a compression link.

7. A crane as defined in claim 6, wherein said compression link comprises a first member having 1) a first end pivotally connected to the upper end of said spar body 2) a second end located between said first end thereof and said spar tip, and 3) an elongated slot formed therein between said first and second ends thereof;

a second, rigid member having 1) a first end pivotally connected to said lower end of said spar tip, 2) a second end located between said first end thereof and said spar body, and 3) an aperture formed therein between said first and second ends thereof; and a pin extending through said aperture in said second member and slidably received in said slot in said first member.

8. A crane as defined in claim 7, wherein said first member comprises a bar and said second member comprises a hollow tube which slidably receives said bar.

9. A crane as defined in claim 7, wherein said link comprises a boom tip bail mounted on said upper end of said boom;

a spar tip bail mounted on said upper end of said spar tip;

a load winch mounted on said spar; and a load line which extends from said load winch to said boom tip bail and which is wound back and forth a plurality of times from said boom tip bail to said spar tip bail, thereby to 1) create a lifting force on said spar tip bail and said auxiliary counterweight assembly and 2) create an upward force on said boom tip and overcome boom deflection.

10. A crane as defined in claim 9, wherein said boom is a telescoping boom.

11. A crane as defined in claim 1, wherein said spar body is removably attached to said platform.

12. A crane comprising:

(A) a ground-supported base;

(B) a platform supported on said base so as to be rotatable about a vertical slewing axis;

(C) an elongated telescoping boom having a lower end pivotally mounted on said platform and having an upper end, said boom being confined to swing relative to said platform substantially in a vertical plane which contains said slewing axis;

(D) an elongated spar which is substantially shorter than said boom, said spar including (1) a spar body having a lower, front end which is non-pivotally and removably mounted on said platform and which is spaced rearwardly from said lower end of said boom, and (2) an upper rigid spar tip formed from a plurality of members immovably attached to one another, said spar tip having a lower end connected to said upper end of said spar body by a) a pivot pin pivotably coupling said spar tip directly to said spar body and b) a lost motion connection, said pivot pin and said lost motion connection operating to render said spar tip capable of limited pivotal motion with respect to said spar body through a range having upper and lower limits, said lost motion connection including a telescoping compression link having a first end pivotally connected to said spar body and a second end pivotally connected to said spar tip, said telescoping compression link including (a) a rigid bar having a first end pivotally connected to the upper end of said spar body and a second end located between said first end thereof and said spar tip, an elongated slot being formed in said bar between said first and second ends thereof, (b) a hollow tube which slidably receives said bar, said hollow tube having a first end pivotally connected to said spar tip and a second end located between said first end thereof and said spar body, an aperture being formed in said tube between said first and second ends thereof and being aligned with said slot in said bar, and (c) a pin which extends through said aperture in said hollow tube and which is slidably received in said slot in said bar;

(E) a main counterweight assembly suspended from said spar body;

(F) an auxiliary counterweight assembly connected to said spar tip so as to be supported by the ground when said spar tip is in its lower limit of pivotal motion but otherwise to be suspended from said spar; and (G) a load lifting and tension link assembly which includes (1) a boom tip bail mounted on said upper end of said boom, (2) a spar tip bail mounted on said upper end of said spar tip;

(3) a load winch mounted on said spar, and (4) a load line extending from said load winch to said boom tip bail and which is wound back and forth a plurality of times from said boom tip bail to said spar tip bail, thereby a) to create a lifting force on said spar tip bail and said auxiliary counterweight assembly and b) to create an upward force on said boom tip and overcome boom deflection, wherein said spar tip, said hydraulic cylinder, said pivot pin, said boom suspension assembly, and said boom interact with one another such that, when said boom deflects forwardly and downwardly upon imposition of a load thereon, said boom deflection is resisted by said auxiliary counterweight assembly but not by said main conterweight assembly until said spar tip reaches an upper limit of pivotal motion, after which further boom deflection is resisted by both said auxiliary counterweight assembly and said main counterweight assembly.

13. A method comprising:

(A) providing a crane including (1) a ground-supported base;

(2) a platform supported on said base;

(3) an elongated boom having a lower end pivotally mounted on said platform and having an upper end, said boom being confined to swing relative to said platform substantially in a vertical plane; and (4) an elongated spar which is substantially shorter than said boom, said spar including a) a spar body having a lower, front end which is mounted on said platform and which is spaced rearwardly from said lower end of said boom, and b) an upper rigid spar tip formed from a plurality of members immovably attached to one another, said spar tip having a lower end connected to said upper end of said spar body by a pivot pin pivotably coupling said spar tip directly to said spar body and a lost motion connection, said lost motion connection being pivotably coupled to said spar body and said spar tip at a location above and behind said pivot pin, said lost motion connection being axially compressible, and (5) a main counterweight assembly suspended from said spar body;

(B) attaching an auxiliary counterweight assembly to said spar tip so that said auxiliary counterweight assembly is supported on the ground;

(c) imposing a load on said boom which causes said second end of said boom to deflect downwardly and forwardly;

(D) pivoting said spar tip about said spar body, without pivoting said spar body, upon said downward and forward movement of said boom, thereby to lift said auxiliary counterweight assembly off the ground so that said auxiliary counterweight assembly resists further movement of said boom, wherein said main counterweight assembly does not resist boom deflection during pivotal motion of said spar tip; then (E) preventing additional pivotal motion of said spar tip; and then (F) resisting additional boom deflection using both said auxiliary counterweight assembly and said main counterweight assembly.

14. A method as defined in claim 13, wherein said attaching step comprises pivoting said spar tip rearwardly and downwardly from a first position in which it is inaccessible by said auxiliary counterweight assembly to a second position in which it is accessible by said auxiliary counterweight assembly, then attaching said auxiliary counterweight assembly to said spar tip, and then pivoting said spar tip back into said first position.

15. A method as defined in claim 14, wherein said step of pivoting said spar tip from said first position to said second position comprises actuating a hydraulic cylinder which has a first end pivotally connected to said spar body and a second end connected to said spar tip.

16. A method as defined in claim 15, wherein said step of pivoting said spar tip upon the imposition of said load on said boom comprises pivoting said spar tip a maximum amount determined by a mechanical stop located on said cylinder.

17. A method as defined in claim 13, wherein said step of providing a lost motion connection comprises providing a telescoping compression link pivotally connected to said spar tip and to said spar body, and wherein said step of pivoting said spar tip upon the imposition of said load on said boom comprises pivoting said spar tip about said pivot pin while said telescoping compression link telescopes.

18. A method as defined in claim 17, further comprising telescoping said boom, and wherein, when said auxiliary counterweight assembly is lifted off the ground, an upward force is imposed on said boom that takes some downward deflection out of said boom.

19. A method as defined in claim 13, wherein said providing step comprises providing a platform which is rotatable about a vertical slewing axis which is positioned at least substantially in said vertical plane, and further comprising rotating said platform about said axis after said step (E).

20. A method as defined in claim 13, wherein said providing step comprises providing a spar body removably attached to the platform, and further comprising removing said spar body from said platform for crane transport.

21. A crane comprising:

(A) a ground-supported base;

(B) a platform supported on said base so as to be rotatable about a vertical slewing axis;

(C) an elongated non-telescoping boom having a lower end pivotally mounted on said platform and having an upper end, said boom being confined to swing relative to said platform substantially in a vertical plane which contains said slewing axis;

(D) an elongated spar which is substantially shorter than said boom, said spar including (1) a spar body having a lower, front end which is non-pivotally and removably mounted on said platform and which is spaced rearwardly from said lower end of said boom, and (2) an upper rigid spar tip formed from a plurality of members immovably attached to one another, said spar tip having a lower end connected to said upper end of said spar body by a) a pivot pin pivotably coupling said spar tip directly to said spar body and b) a lost motion connection, said lost motion connection comprising a hydraulic cylinder having a first end pivotally connected to said spar body and a second end pivotally connected to said spar tip at a location above and behind said pivot pin, said pivot pin and said hydraulic cylinder operating to render said spar tip capable of limited pivotal motion with respect to said spar body through a range having upper and lower limits;

(E) a main counterweight assembly suspended from said spar body;

(F) an auxiliary counterweight assembly connected to said spar tip so as to be supported by the ground when said spar tip is in its lower limit of pivotal motion but otherwise to be suspended from said spar tip, wherein said cylinder is extendible upon demand to pivot said spar tip into a position permitting connection of said auxiliary counterweight assembly to said spar tip;

(G) a load lifting assembly including (1) a first winch mounted on said spar, (2) a first sheave assembly mounted on said upper end of said boom, (3) a load block, and (4) a load line extending from said first winch, over said first sheave assembly, and to said load block; and (H) a boom suspension assembly which includes (1) a second winch mounted on said spar;

(2) a second sheave assembly mounted on said spar;

(3) a spar tip bail mounted on said spar tip;

(4) an outer bail located between said upper end of said spar tip and said upper end of said boom;

(5) a pendant extending from said outer bail to said upper end of said boom; and (6) a tension line extending from said second winch, to said second sheave assembly, to said spar tip bail, and to said outer bail, said tension line maintaining a designated distance between said upper end of said boom and said upper end of said spar tip, said designated distance being variable by operation of said second winch, wherein said spar tip, said hydraulic cylinder, said pivot pin, said boom suspension assembly, and said boom interact with one another such that, when said boom deflects forwardly and downwardly upon imposition of a load thereon, said boom deflection is resisted by said auxiliary counterweight assembly but not by said main conterweight assembly until said spar tip reaches an upper limit of pivotal motion, after which further boom deflection is resisted by both said auxiliary counterweight assembly and said main counterweight assembly.

* * * * *